United States Patent [19]

Quinn, Jr. et al.

[11] 4,272,204

[45] Jun. 9, 1981

[54] AUTOMATIC MARGIN DETERMINING APPARATUS FOR A SCANNED SHEET OF PAPER

[75] Inventors: Paul A. Quinn, Jr.; Walter J. Wipke, both of Lexington, Ky.

[73] Assignee: International Business Machines Corporation, Armonk, N.Y.

[21] Appl. No.: 972,100

[22] Filed: Dec. 21, 1978

[51] Int. Cl.[3] ..... B41J 21/02

[52] U.S. Cl. ..... 400/342; 400/279; 400/320; 400/705.1; 400/708

[58] Field of Search ..... 400/2, 126, 279, 282, 400/320, 342, 705, 705.1, 705.5, 703, 708, 708.1; 346/75; 355/3 R; 250/237 G

[56] References Cited

U.S. PATENT DOCUMENTS

| | | | |
|---|---|---|---|
| 3,020,996 | 2/1962 | D'Onofrio | 400/282 X |
| 3,785,471 | 1/1974 | Dodds | 400/705.5 X |
| 3,809,472 | 5/1974 | Liechty | 355/3 R |
| 3,831,728 | 8/1974 | Woods et al. | 400/126 X |
| 4,152,083 | 5/1979 | Kostoff | 400/342 |
| 4,180,703 | 12/1979 | Cialone et al. | 250/237 G |
| 4,180,704 | 12/1979 | Pettit | 250/237 G |

FOREIGN PATENT DOCUMENTS

| | | | |
|---|---|---|---|
| 2749976 | 5/1978 | Fed. Rep. of Germany | 400/320 |
| 2705282 | 8/1978 | Fed. Rep. of Germany | 400/282 |

OTHER PUBLICATIONS

IBM Technical Disclosure Bulletin, "Paper Edge Sensing", Smith, vol. 20, No. 3, Aug. 1977, p. 904.

IBM Technical Disclosure Bulletin, "Right Hand Margin Set and Print Inhibit", Wipke, vol. 20, No. 10, Mar. 1978, pp. 3996–3997.

IBM Technical Disclosure Bulletin, "Side-of-Forms, End-of-Forms, and Forms Jam-Detection Scheme for Printers", Brown et al, vol. 20, No. 11A, Apr. 1978, pp. 4266–4269.

*Primary Examiner*—Ernest T. Wright, Jr.

*Attorney, Agent, or Firm*—William J. Dick; Kenneth W. Hairston

[57] ABSTRACT

In a typewriter environment, a carrier mounted sensor for calculating the width of a sheet of paper on the platen and for thereafter setting-up margins for that sheet of paper. In addition to supporting the sensor, the carrier supports the printhead and associated apparatus for detecting the position of the carrier relative to the platen at each escapement position of the carrier. The sensor starts its scan at the extreme left position of the carrier and senses the left edge of the paper at a transition from dark-(the platen surface) to-light (the sheet of paper). This transition point is detected and stored. The carrier continues its rightward scan and the right edge of the sheet of paper signals a transition from light-to-dark. This position is detected and stored. The carrier and sensor continue scanning to the right for a specific distance to eliminate errors that are caused by dark areas on the paper that prematurely trigger light-to-dark transitions. At the end of the scan, the recorded distances yield the width of the sheet of paper and from this recorded width, margins of a predetermined size are determined for setting thereof.

9 Claims, 9 Drawing Figures

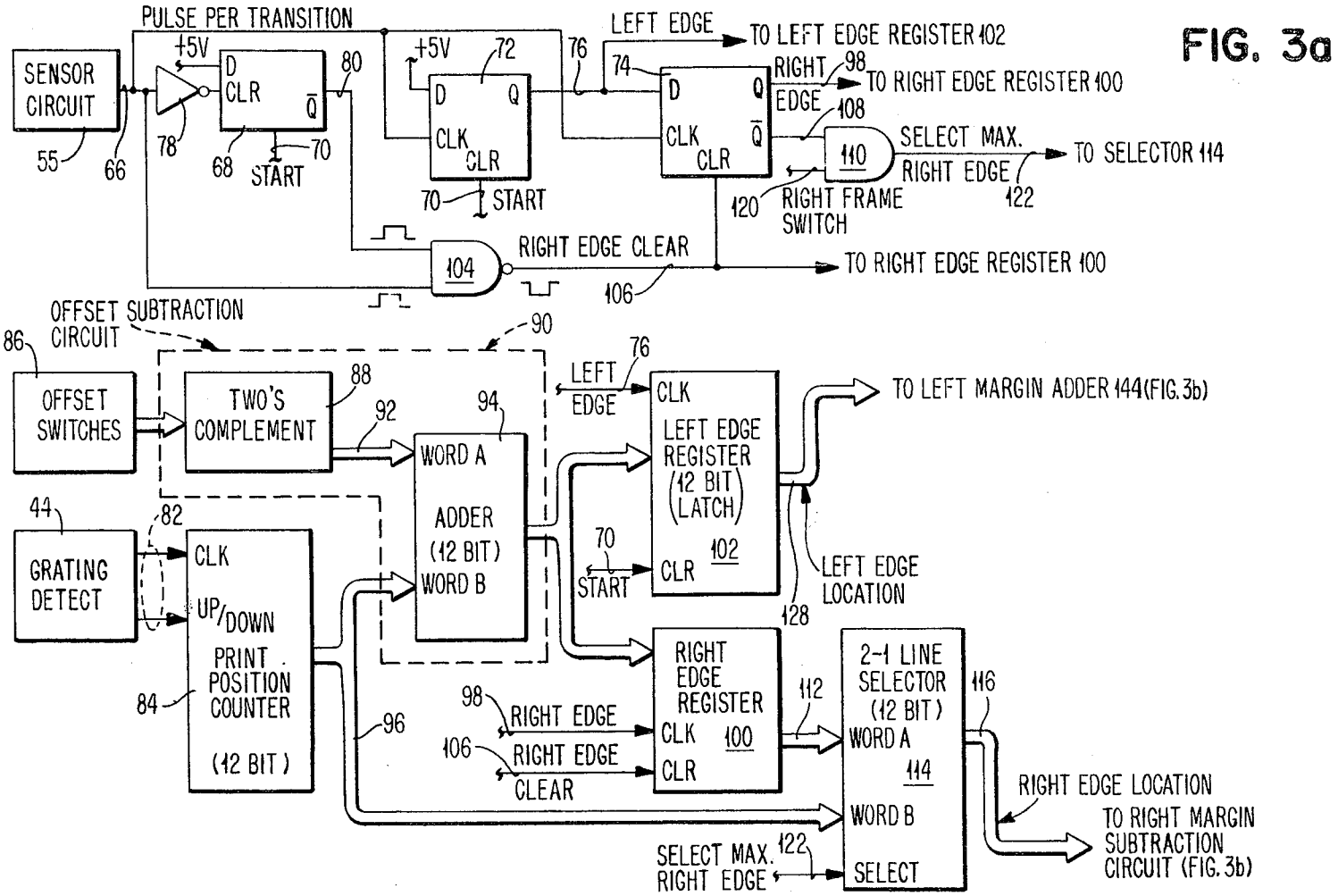
FIG. 3a
TO LEFT EDGE REGISTER 102
TO RIGHT EDGE REGISTER 100
TO SELECTOR 114
TO RIGHT EDGE REGISTER 100
TO LEFT MARGIN ADDER 144 (FIG. 3b)
RIGHT EDGE LOCATION
TO RIGHT MARGIN SUBTRACTION CIRCUIT (FIG. 3b)
LEFT EDGE
RIGHT EDGE
SELECT MAX.
RIGHT FRAME SWITCH
RIGHT EDGE CLEAR
START
+5V
PULSE PER TRANSITION
SENSOR CIRCUIT
OFFSET SUBTRACTION CIRCUIT
OFFSET SWITCHES
TWO'S COMPLEMENT
WORD A
ADDER (12 BIT)
WORD B
GRATING DETECT
UP/DOWN
PRINT POSITION COUNTER (12 BIT)
LEFT EDGE REGISTER (12 BIT) (LATCH)
RIGHT EDGE REGISTER
2-1 LINE SELECTOR (12 BIT)
SELECT
LEFT EDGE LOCATION
CLEAR
CLK
CLR
D
Q
55
66
68
70
72
74
76
78
80
82
84
86
88
90
92
94
96
98
100
102
104
106
108
110
112
114
116
120
122
128
144

AUTOMATIC MARGIN DETERMINING APPARATUS FOR A SCANNED SHEET OF PAPER

The invention in this application is related to the invention contained in patent application Ser. No. 971,982 filed on Dec. 21, 1978, inventors M. L. Krieg et al and, entitled "Apparatus for Setting Proportional Margins Based Upon the Width of A Scanned Sheet of Paper", and assigned to the assignee of the present application.

BACKGROUND OF THE INVENTION

I. Field of the Invention

This invention relates to a mechanism for determining the margins for a sheet of paper in a typewriter, and more particularly to a carrier mounted sensor and associated apparatus and circuitry for determining the width of the sheet of paper and for setting margins of a predetermined width.

II. Prior Art

Heretofore, the setting of margins for a sheet of paper has been left almost entirely to the skill and judgement of the typist. For standard size paper, this does not present a problem. However, if variable widths of paper are used, margins as numerous as the sheet widths may result.

In the prior art there are teachings of preprogrammed margins and tab racks. For example, U.S. Pat. No. 3,020,996 discloses an optical sensing mechanism for sensing marks on the sheet to control tab position settings. This patent further provides for mechanically settable margins. U.S. Pat. No. 3,785,471 teaches the automatic setting of left and right margins in accordance with the position of a center point indicator so that the margin stops are positioned by movement of the pointer to correspond to the margins required for a particular letter size (e.g., the number of words in the letter). While a form of sensing is disclosed by one reference and the teaching of automatic margin setting is disclosed in another, sheet width sensing and automatic margin setting in accordance with this sensed width is not disclosed in the prior art.

It is known in the prior art to utilize the sensed size of a sheet to control machine function. Exemplary of patents teaching this type of application is U.S. Pat. No. 3,809,472 which discloses a xerographic device in which the size of sheet being transported through a xerographic copier is sensed in order to control the exposure given the side portions of a photoconductive drum. In effect, the photoconductive drum is charged by an amount determined by the width of the sheet to be utilized in the copy machine.

Again, none of the prior art teaches the concept of sensing the sheet width in order to automatically control the setting of margins in a typewriter mechanism.

OBJECTS OF THE INVENTION

It is an object of this invention to uniformly and automatically set sheet margin widths.

It is another object of this invention to automatically set individual sheet margins after sensing the width and position of a sheet of paper on the platen.

SUMMARY OF THE INVENTION

The above objects are accomplished through the use of a carrier mounted sensor that senses dark-to-light and light-to-dark transitions between the platen and the sheet of paper held thereto. The carrier mounted sensor starts a scan at the left edge of the platen. Assuming that the platen is darker in color than the sheet of paper, the sensor detects a transition from dark-to-light at the left edge of the sheet of paper and a light-to-dark transition at the right edge of the sheet. The scan continues past the light-to-dark transition to compensate for premature transition signals caused by dark areas on the light sheet of paper. The distance between these two transitions corresponds to the width of the sheet of paper.

After the sheet width is determined, margins are now set a predetermined distance from both edges of the sheet of paper. The location of these margins for the sheet of paper are determined by comparing the aforementioned sensed information with information from a carrier mounted scanner that determines the location of the carrier, relative to the platen, at each step of the carrier. From this comparison, the number of counts required for the carrier in its extreme left position to reach the left edge of the paper, the right edge of the paper, as well as the two margins, are determined. The print apparatus on the carrier can now start printing.

The foregoing and other objects, features and advantages of the invention will be apparent from the following more particular description of the preferred embodiment of the invention as illustrated in the accompanying drawing.

BRIEF DESCRIPTION OF THE DRAWING

FIGS. 3*a* and 3*b* are schematic block diagrams of apparatus for providing an output indicative of both the left and right margins for a scanned sheet of paper;

BRIEF DESCRIPTION OF THE PREFERRED EMBODIMENT

Figure 1:
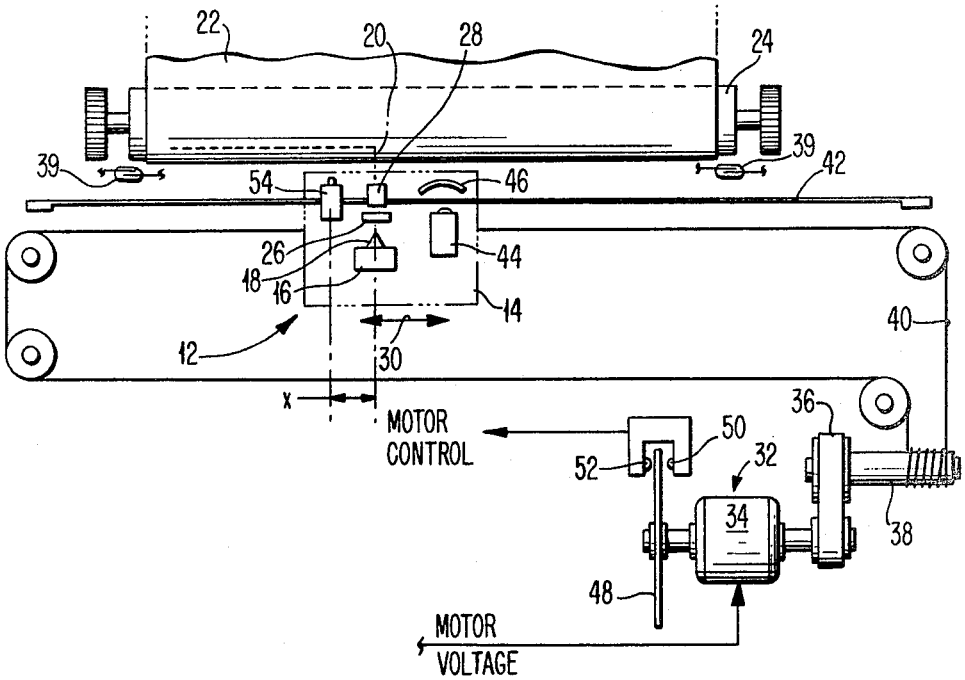
FIG. 1 diagrammatically illustrates a carrier mounted printer and scanner mechanisms constructed in accordance with the present invention.
Figure 2:
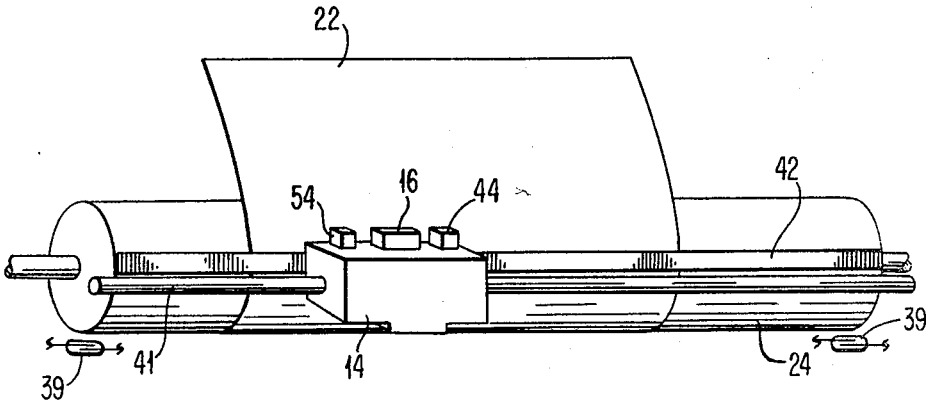
FIG. 2 is an oblique side view of the mechanism of FIG. 1.

Referring to FIGS. 1 and 2, an ink jet printer 12 is illustrated which includes, inter alia, a carrier 14 upon which printing apparatus is mounted. The printing apparatus includes an ink jet print head 16 with a nozzle 18 thereon for emitting a stream of ink 20 towards paper 22 on platen 24. The stream of ink 20 contains individual droplets formed by pressure perturbations on the stream 20 in ink jet print head 16. While in flight towards platen 24, the individual drops in the stream 20 are charged by charge electrode 26 and then passed through deflection electrodes 28 before impinging upon paper 22 or other print receiving media on platen 24.

In FIGS. 1 and 2, carrier 14 is movable relative to platen 24 in the direction of arrow 30 by drive source 32. The drive source 32 includes DC motor 34 coupled in a convenient manner to carrier 14 to effect displacement of the carrier 14 relative to the print receiving media 22. As seen in FIG. 1, the DC motor 34 is connected as by a timing belt 36 or its equivalent to a cable wound drum 38 having several turns of cable 40 thereon which are connected to opposite sides of carrier 14 so that motor rotation, depending upon direction, will effect carrier motion in the direction of arrow 30. As seen in FIG. 2, a guide rod 41 supports and guides carrier 14 in its movement along the length of platen 24. A pair of reed switches 39 are provided at both ends of platen 24 which are activated when ink jet print head 16 on carrier 14 passes thereby.

In order to insure that the location of the carrier 14 is correct relative to start of print and that the direction of movement of the carrier 14 relative to paper 22 is correct, means is provided for locating the carrier 14 at any time during its movement in the direction of arrow 30. To accomplish this, a grating strip 42 is employed in conjunction with a light emitting and detection module 44 (grating strip scanner), including a mirror 46, to permit both a position indicating control for the carrier 14 and a direction of movement control for carrier 14. A more complete explanation for the grating strip 42 and its associated scanner 44 is illustrated and described in patent applications Ser. No. 920,305 filed on June 28, 1978 inventors D. R. Cialone et al, now U.S. Pat. No. 4,180,703, issued Dec. 25, 1979, and entitled "Bi-Directional Self Imaging Grating Detection Apparatus" and Ser. No. 920,306, filed also on June 28, 1978, inventor J. W. Pettit, now U.S. Pat. No. 4,180,704, issued Dec. 25, 1979 and entitled "Detection Circuit for A Bi-Directional Self Imaging Grating Detection Apparatus", both applications being assigned to the assignee of the present application and both patents being herein incorporated by reference.

To find the velocity of motor 34, a plurality of slots, adjacent the periphery of emitter wheel 48 on motor 34, pass between the encoder comprised of a light emitting diode 50 or its equivalent and a phototransistor 52 so that a pulse is emitted by the phototransistor 52 upon the passage of a slot between the light emitting diode 50 and the phototransistor 52. The signal information derived is processed in circuitry (not shown) to arrive at a control voltage for motor 34. A more complete explanation of such circuitry is found in patent application Ser. No. 954,374, filed on Oct. 24, 1978, inventors D. B. Morgan et al and entitled "Printer Escapement Control System", assigned to the assignee of the present application and incorporated herein by reference.

The paper scanner 54 of this invention is also conveniently located on carrier 14. As seen in FIGS. 1 and 2, paper scanner 54 is mounted on carrier 14 opposite grating strip scanner 44. Scanner 54 traverses the length of paper 22 and platen 24 during a scan operation. Any conventional scanner capable of distinguishing between dark and light areas and registering changes between the two can be used as a scanner 54. FIG. 4 sets forth apparatus and circuitry 55 for a scanner meeting the specifications of scanner 54. This scanner 54 includes an LED 56 or a similar light emitting device and a phototransistor 58 connected to form a Darlington pair 60. In operation, phototransistor 58 senses any change in the radiant energy from LED 56 reflected off of either paper 22 or platen 24 (depending upon the location of carrier 14 and the size of the paper 22 on the platen 24). A change occurs whenever there is a transition from dark-to-light (platen 24 to paper 22) or light-to-dark (paper 22 to platen 24). A current signal is generated which is thereafter converted by transistor 62 to a voltage appropriate to be applied to Schmitt trigger 64. The digital output on line 66 from Schmitt trigger 64, in the form of a pulse per transition (as stated above), is applied to latch 68 shown in FIG. 3*a*.

A start signal enters latches 68 and 72 over line 70 when carrier 14 begins its travel along the length of platen 24. At this time, scanner 54 is scanning along the dark area of platen 24. The first transition is a dark-to-light transition that occurs when the scanner 54 encounters the extreme left edge of paper 22. Sensor circuit 55 produces a pulse at every transition over line 66 to latches 68, 72 and 74.

As stated, a start signal enters latches 68 and 72 over line 70 when carrier 14 begins its travel along the length of platen 24. (This signal can be seen at point 200 on the timing diagram of FIG. 5). At this time, paper scanner 54 is scanning along the dark area of platen 24. The first transition will be a dark-to-light transition that occurs when the scanner 54 encounters the extreme left edge of paper 22. The paper scanner circuitry 55 produces a pulse at every transition over line 66 to latches 68, 72 and 74. When the left edge of paper 22 is sensed, the positive edge of the transition signal on line 66, in FIG. 3, triggers latches 72 and 74. A left edge output pulse to this effect outputs latch 72 over a line 76 to latch 74 and to a register 102 to be discussed further hereinafter.

The inverter 78 is located between paper scanner circuit 55 and latch 68 so that the trailing edge of a transition pulse will trigger latch 68 to cause a completion of light-to-dark pulse to appear on line 80. The function of this pulse on line 80 will be discussed more fully hereinafter.

As stated previously, grating strip scanner 44 detects the position of the carrier 14 at every step or position of the carrier 14 and outputs this information over lines 82 to print position counter 84 as seen in FIG. 3*a*. Consequently, the position along the grating strip 42, corresponding to the location at which the left edge of the sheet of paper 22 was detected on platen 24, is recorded.

Figure 6:
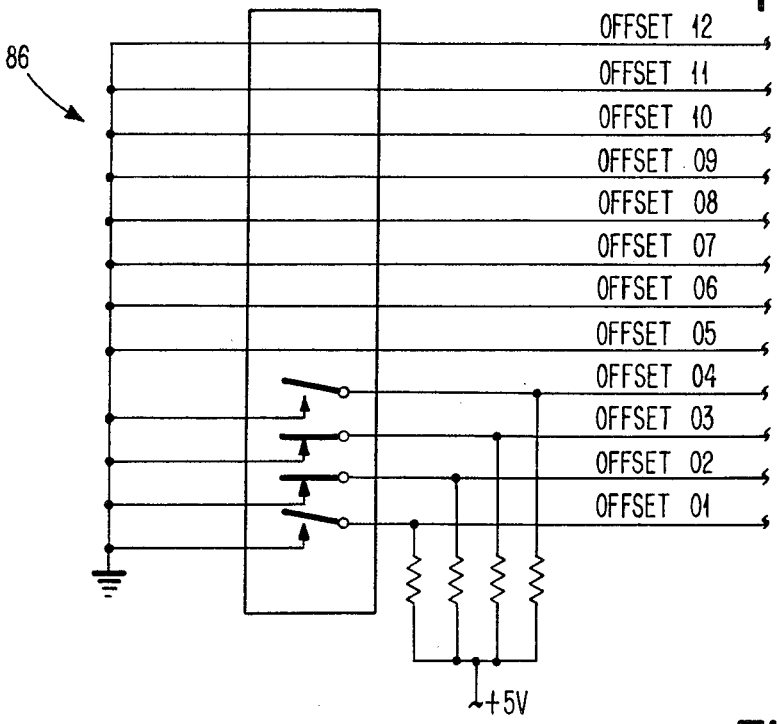
FIG. 6 is a schematic diagram of switching circuitry for the offset switching block illustrated schematically in FIG. 3*a;*
Figure 7:
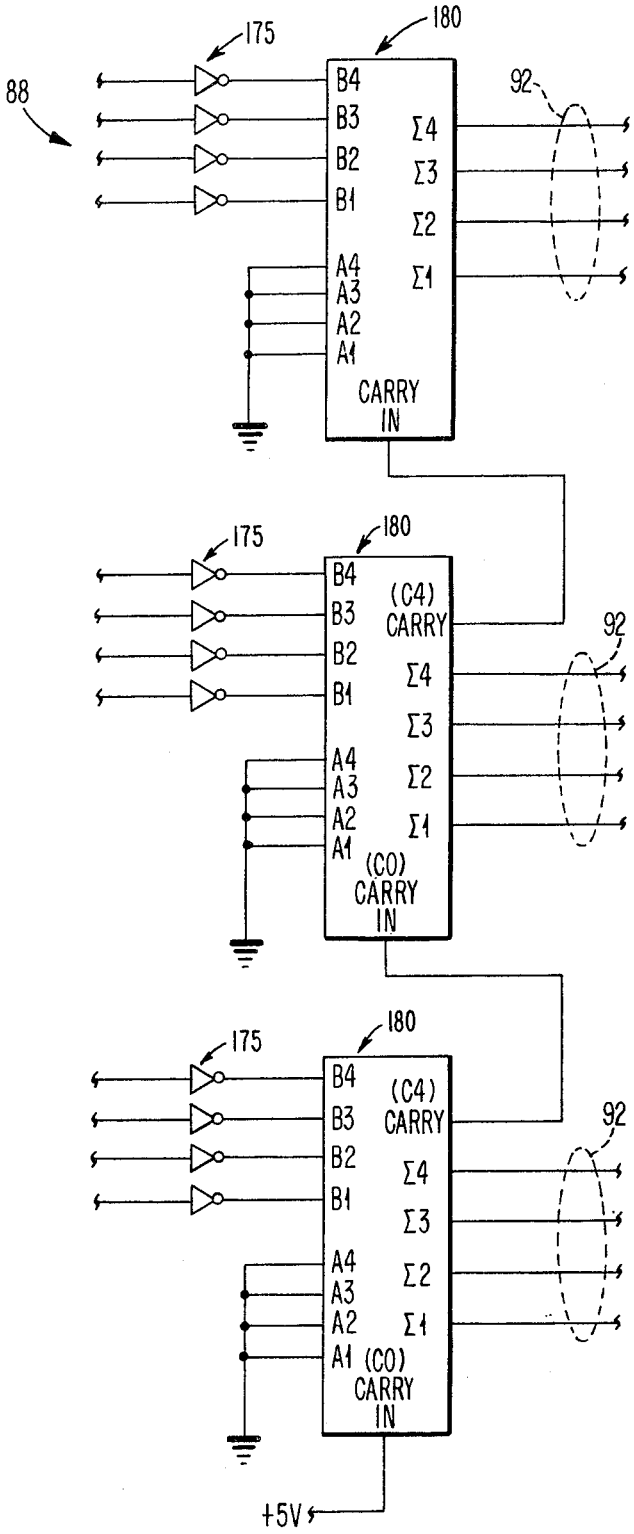
FIG. 7 illustrates logic circuitry for the two's complement boxes illustrated schematically in FIGS. 3*a* and 3*b;*

When paper scanner 54 first encounters the left edge of paper 22, ink jet printhead 16 is a distance (x) away from the left edge of paper 22. To compensate for this offset distance, a set of offset switches 86, shown in FIGS. 3*a* and 6, are used to compensate for this offset distance (x) between scanner 54 and ink jet printhead 16. The offset switches 86 shown in FIG. 6 are standard switches programmed to compensate for the distance (x). For purposes of illustration, the offset distance (x) between ink jet printhead 16 and paper scanner 54 is a distance of 9 individual counts on grating strip 42. As a result of the offset switch circuitry 86, in FIG. 6, ink jet print head 16 will appear to the logic in FIG. 3*a* to be at the left edge of paper 22 even though it is 9 individual grating counts to the right of the left edge of paper 22 at that particular time. This offset compensation count from offset switches 86, in FIG. 6, outputs to two's complement circuit 88 which is part of offset subtraction circuit 90. An example of a two's complement 12 bit binary circuit 88 is set forth in FIG. 7. This two's complement circuit is comprised of a series of inverters 175 and adders 180. When a binary word enters the inverters 175 of two's complement circuitry 88, it is inverted and a one is added to it and this inverted word is rippled through the series of adders 180 to yield the two's complement sum of the word. The two's complement output on line 92 goes to adder 94 of offset subtraction circuitry 90 where it is subtracted from the print position counter information from counter 84 which inputs adder 94 over line 96. This subtraction operation is carried out because grating detector 44 is detecting the position of ink jet printhead 14 relative to the platen 24 at each count and not the position of paper scanner 54 at each count along grating strip 42. The subtraction operation yields the true position of the left edge of paper 22 with respect to printhead 16.

As scanning continues along the width of paper 22, a false right paper edge pulse will be generated by latch 74 on line 98, which inputs right edge register 100, if a dark area (e.g., preprinted letterhead) on paper 22 is scanned by paper scanner 54. A false light-to-dark transition pulse will be generated on line 66 that will cause latch 74 and other logic elements in FIG. 3*a* to believe that the right end of paper 22 has been sensed. On the timing diagram of FIG. 5, the light-to-dark transition pulse can be seen at point 202 on the transition line. In this same timing diagram, it can be seen that a left edge pulse 204 was generated when the dark-to-light transition pulse 206 occurred. Likewise, a right edge pulse 208, even though a false one, is formed when the light-to-dark pulse 202 is generated by paper scanner circuit 55. At the completion of the light-to-dark pulse from paper scanner circuit 55, the latch 68 will register a completion of light-to-dark pulse over line 80 to gate 104. This completion of light-to-dark pulse can be seen on the timing diagram of FIG. 5 at point 210 on the completion line.

As the paper scanner 54 continues its sweep across paper 22 and leaves the aforementioned dark area on paper 22, if another light area on paper 22 is sensed, a dark-to-light transition pulse from the paper scanner circuit 55 will be generated (as seen at point 212 in FIG. 5) over line 66 to gate 104. This high pulse combined with the other high pulse (false completion of light-to-dark pulse) from latch 68 in gate 104 will cause a low pulse on line 106 which is a right edge clear signal for both latch 74 and right edge register 100. Consequently, this dark-to-light transition pulse tells the system and associated logic that the prior light-to-dark transition signal (which would correspond to the right edge of paper 22) was a false one and to ready itself for another light-to-dark transition signal. This false value is cleared or erased from both latch 74 and right edge register 100 by this right edge clear signal on line 106.

Figure 5:
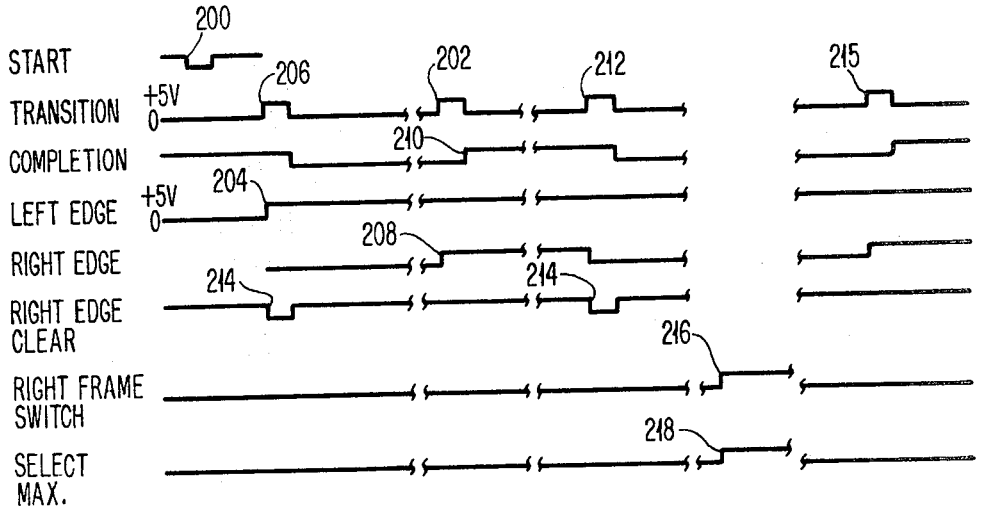
FIG. 5 is a timing diagram related to the margin setting apparatus of FIGS. 3*a* and 3*b;*

As seen in the timing diagram of FIG. 5, a right edge clear signal 214 occurs whenever a dark-to-light transition occurs (e.g., when the paper scanner 54 first encounters the left edge of paper 22 and after writing on the paper 22 has triggered a false light-to-dark transition pulse).

The output 108 from latch 74 that inputs gate 110 remains high until the right edge of paper 22 is detected. Whenever the right edge of paper 22 is detected, an output to this effect will appear on output 98 from latch 74. This output from latch 74 inputs right edge register 100. On the timing diagram of FIG. 5, whenever the right edge signal goes high or a light-to-dark transition occurs, the signal on line 108 will always be opposite to it. The left edge output pulse on line 76 from latch 72 has already inputted left edge register 102 at this time.

When the right edge of paper 22 is sensed by paper scanning circuit 55, a pulse on line 66 to latch 74 will cause a right edge signal output on line 98 which will be recorded in right edge register 100. This light-to-dark transition pulse occurs at point 215 on the transition line shown in FIG. 5. If a true right edge of paper 22 is sensed, an output 112 from right edge register 100 will input selector 114. A selector circuit suitable for use in this invention can be a Texas Instruments Quadruple 2-Line-To-1-Line Data Selector/Multiplexer, Ser. No. 74157.

If the right edge of paper 22 is not sensed by paper scanner 54 and reed switch 39 is triggered by the ink jet print head 16 on carrier 14 when it reaches an extreme right position relative to platen 24, a right frame switch signal generated by reed switch 39 on line 120 will enter gate 110. The period at which the right frame reed switch 39 is activated is shown in FIG. 5 at 216. Since line 108 already contains a high signal, AND gate 110 will be gated and a select maximum right edge value corresponding to the highest count value determined by grating strip scanner 44, will be selected as the right edge value for paper 22. (See select maximum right edge pulse 218 in the timing diagram of FIG. 5). This value will appear on line 122 which inputs selector 114. When such a signal occurs, selector 114 will receive a counter signal over line 96, from print position counter 84, which corresponds to the position at which the right margin reed switch 39 was activated. Again, the output of selector 114 in this instance would be on line 116.

Figure 3B:
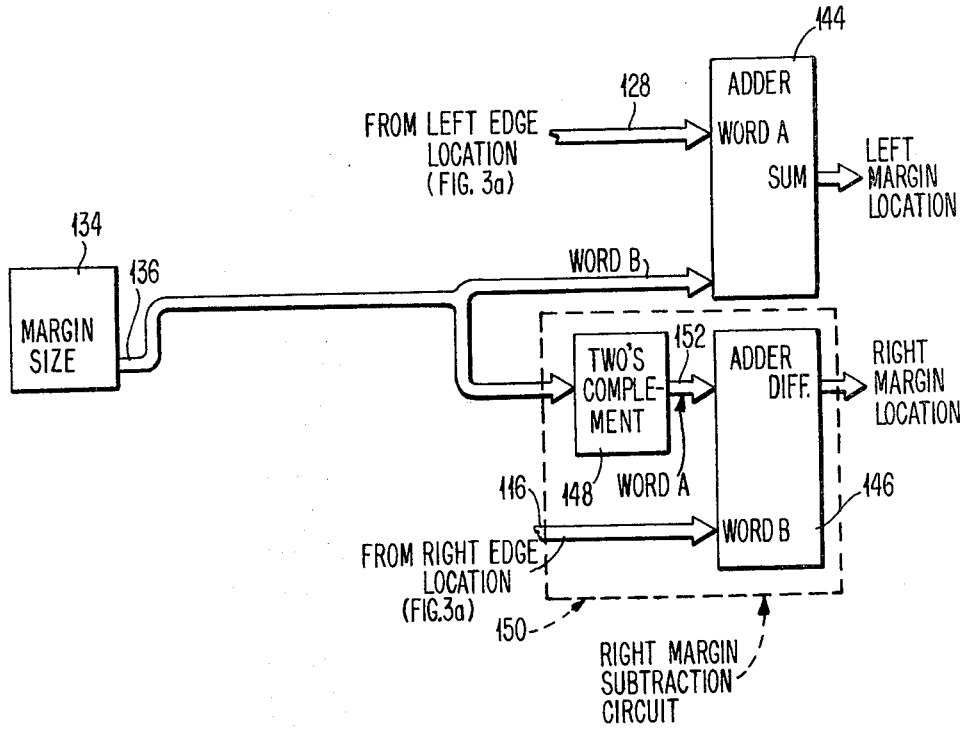
Figure 4:
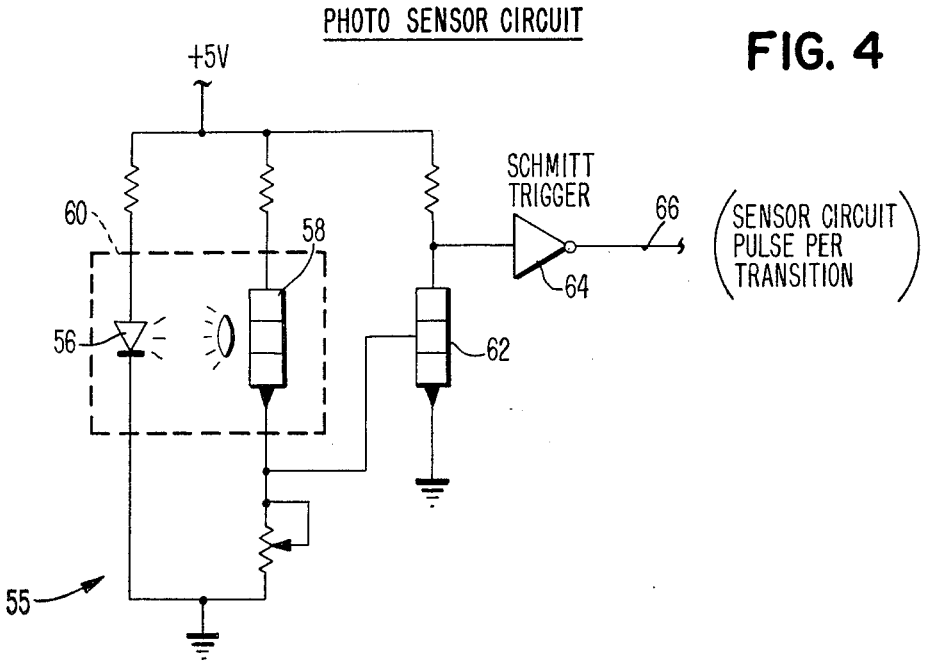
FIG. 4 is a schematic diagram of circuitry for the scanner mounted on the carrier shown in FIG. 1.
Figure 8:
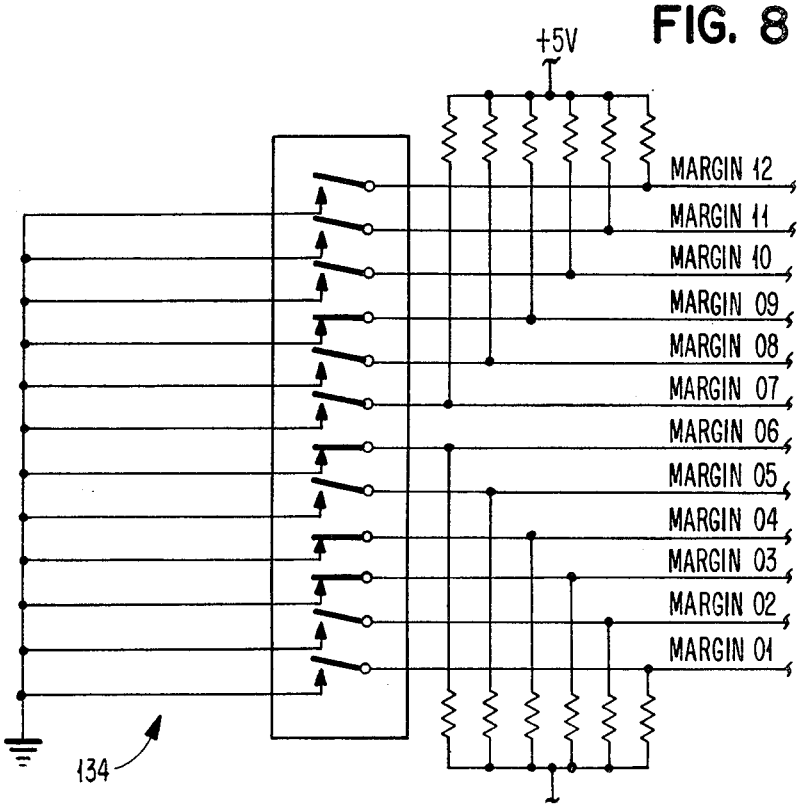
FIG. 8 is a schematic diagram of switching circuitry for the margin size block illustrated schematically in FIG. 3*b*.

In FIG. 8, switch circuitry 134, corresponding to block 134 in FIG. 3*b*, is shown for determining a margin size for the paper 22. A desired margin size is programmed by the switches 134 shown in FIG. 8. (The series of switches 134 shown are standard TTL switches). For purposes of illustration, the value programmed into margin size switches 134 has been set to a decimal count of 300 or 30 millimeters on each side of the sheet of paper 22. This value was selected assuming that each grating position count on grating strip 42, as shown in FIG. 1, represents 0.1 millimeter. Accordingly, the 12 bit up-down print position counter 84, seen in FIG. 3*a*, will allow a paper width of approximately 409.5 millimeters for the grating strip 42 and platen 24 shown in FIG. 1.

The output margin value on line 136 inputs adder 144 and is combined therein with the sensed left paper edge value on line 128. The combination of these two values will yield, at the output of adder 144, the actual location of the left margin for the particular piece of paper 22 on platen 24.

In order to determine the right margin value, the right edge value of the paper 22 on line 116 from selector 114 inputs adder 146 where it is combined with the margin value on line 136 from margin size circuit 134. Before these two values are combined, the value on line 136 goes through two's complement circuit 148. Adder 146 and two's complement circuit 148 form a right-margin subtraction circuit 150 that is substantially similar to the offset subtraction circuit 90. In essence, the output value on line 152 from two's complement circuit 148 becomes a difference value to the right margin value when they are combined in adder 146. The output of adder 146 is the location of the right margin for paper 22.

While the invention has been shown and described with reference to a preferred embodiment thereof, it will be appreciated by those having skill in the art that variations in form and detail may be made therein without departing from the spirit and scope of the invention.

What is claimed is:

1. An automatic margin determining apparatus for a typewriter including:

a platen for supporting a sheet of paper thereon;

a carrier having printing means thereon for printing indicia on the sheet of paper supported on said platen;

drive means for effecting relative movement between said carrier and said platen;

optical sensing means on said carrier for relative translation therewith;

means coupled to said sensing means for providing a first output signal indicative of the left edge of said sheet of paper and a second output signal indicative of the right edge of said sheet of paper upon relative translation of said carrier and platen;

means for producing a third signal indicating the position of said carrier relative to said platen during relative movement therebetween;

means for producing from said first, second and third signals, a signal including the position of said carrier with respect to said paper edges;

and margin determining means including programmable means for setting a predetermined value distance from said left and right edges of said paper, and means to combine said predetermined value with said left edge position to indicate and define a left margin location, and to combine with said right edge position to define the location of the right margin relative to the paper.

2. The automatic margin determining apparatus of claim 1 wherein said means for producing a third signal includes a grating means for indicating print positions along the length of said platen; and a grating scanner for detecting the location of said printing means relative to said platen at every print position.

3. Automatic margin determining apparatus in accordance with claim 1 wherein said means coupled to said optical sensing means to provide said first and second output signals comprises a sensing circuit means.

4. The automatic margin determining apparatus of claim 3 wherein said optical sensing means senses the transitions between said platen and the sheet of paper supported thereon for providing said first and second signals.

5. The automatic margin determining apparatus of claim 4 wherein said first and second signals are in the form of pulses and wherein said means for producing from said first, second and third signals includes at least two latches being triggered by a pulse from said sensing circuit means at every transition between said platen and the sheet of paper, and at least two registers for storing the transition information output from said two latches; the transition information corresponding to the locations of the left and right edges of the sheet of paper.

6. The automatic margin determining apparatus of claim 5 further including a third latch means and a gate means for clearing the latch of said at least two latches, and the register of said at least two registers, said cleared register being the register that records and stores transition information pertaining to the location of the right edge of the sheet of paper when a transition is detected, and said cleared latch being the latch that is triggered by dark material on the sheet of paper and not by the platen at the right edge of the sheet of paper.

7. The automatic margin determining apparatus of claim 5 further including right edge switch means located at the extreme right end of said platen, said switch means being activated when relative motion between said platen and said carrier reaches an extreme right position and the location of the right edge of the sheet of paper is not detected by said paper scanner; said switch means, when activated, providing a signal output indicating that the location of the right edge switch means is the location of the right edge of the sheet of paper.

8. An automatic margin determining apparatus for an ink jet typewriter including:

a platen for supporting a sheet of paper thereon;

a carrier mounted for driving displacement along a path parallel to said platen;

ink jet printing means mounted on said carrier for printing indicia on the sheet of paper supported on said platen;

first optical sensing means mounted on said carrier for movement therewith for defining the location of the left and right edges of the sheet of paper supported on said platen during displacement of said carrier;

second optical sensing means for detecting the location of said ink jet printing means at every print position;

said first optical sensing means sensing transitions between said platen and the sheet of paper to locate the left and right edges of the sheet of paper;

latch means triggered by every transition between said platen and the sheet of paper;

means for storing the transition information from said latch means;

means for locating said right and left edges of said paper relative to said ink jet printing means;

a programmable margin setting means for determining the width of the margins for the sheet of paper; and means for adding a predetermined margin width to the location of the left edge of the sheet of paper and means for subtracting said predetermined margin width from the location of the right edge of the sheet of paper to yield both the left and right margins for the sheet of paper.

9. The automatic margin determining apparatus of claim 8 wherein said means for subtracting consists of a two's complement circuit and an adder.

* * * * *

UNITED STATES PATENT AND TRADEMARK OFFICE

CERTIFICATE OF CORRECTION

PATENT NO. : 4,272,204

DATED : June 9, 1981

INVENTOR(S) : Paul A. Quinn, Jr. and Walter J. Wipke

It is certified that error appears in the above-identified patent and that said Letters Patent are hereby corrected as shown below:

Claim 1 line 18 Delete "including" insert --indicating--

Signed and Sealed this

*Nineteenth* Day of *October 1982*

[SEAL]

*Attest:*

GERALD J. MOSSINGHOFF

*Attesting Officer*

*Commissioner of Patents and Trademarks*